United States Patent [19]

McConnell

[11] 3,976,915

[45] Aug. 24, 1976

[54] GATE PROTECTION CIRCUIT FOR ELECTRONIC FLASH APPARATUS

[75] Inventor: Robert G. McConnell, Fort Collins, Colo.

[73] Assignee: Honeywell Inc., Minneapolis, Minn.

[22] Filed: May 27, 1975

[21] Appl. No.: 580,649

[52] U.S. Cl. ..... 315/241 P; 307/252 K; 315/151

[51] Int. Cl.[2] ..... H05B 41/32

[58] Field of Search ..... 315/241 P, 151, 159, 315/179, 190, 193; 354/145, 147; 307/246, 252 K, 252 M

[56] References Cited

UNITED STATES PATENTS 3,809,954 5/1974 Engelstatter ..... 315/241 P X 3,878,433 4/1975 Sato ..... 315/241 P

*Primary Examiner*—Eugene La Roche

*Attorney, Agent, or Firm*—David R. Fairbairn

[57] ABSTRACT

In electronic flash apparatus having a flash trigger switch and a flash termination switch, protection against damage from large negative gate voltages is provided. The gate of the flash trigger switch is connected to the cathode of the flash termination switch, and the gate of the flash termination switch is connected to the cathode of the flash trigger switch.

7 Claims, 2 Drawing Figures

GATE PROTECTION CIRCUIT FOR ELECTRONIC FLASH APPARATUS

REFERENCE TO COPENDING APPLICATIONS

Subject matter disclosed but not claimed herein is disclosed and claimed in the following copending applications which are filed on even date herewith and are assigned to the same assignee as the present application: Ser. No. 580,651 entitled "Series SCR Gate Hold-on Circuit" by Robert G. McConnell; and Ser. No. 580,650 entitled "Electronic Flash Apparatus with Inhibition of Contact Bounce False Triggering" by James R. Adams, Jr. and Dennis J. Wilwerding.

BACKGROUND OF THE INVENTION

The present invention relates generally to light controlling systems. In particular, the present invention is directed to improved electronic flash apparatus.

Electronic flash apparatus is known in the art in which the flash of light produced by a flash tube is automatically terminated after a predetermined total quantity of light has been received from the scene being illuminated. In one particular type of electronic flash apparatus, a flash terminating switch is connected in series with the flash tube. When a light flash is to be produced, both the flash tube and the flash terminating switch are switched to a conductive state. When an exposure control circuit has received the predetermined quantity of light, the flash termination switch is switched into a non-conductive state, thereby terminating the flash.

One specific type of electronic flash apparatus of this general type is shown in FIG. 2 of U.S. Pat. No. 3,727,100 by Kuraishi et al. and in U.S. Pat. No. 3,809,954 by Engelstatter. In this specific type of electronic flash apparatus, a flash trigger switch (generally a silicon controlled rectifier (SCR)) is used to trigger the flash tube and the flash termination switch. Contacts and a capacitor are connected to the control electrode (gate) of the flash trigger switch. When the contacts close, the capacitor discharges, thereby switching the flash trigger switch to a conductive state.

The flash trigger switch is connected in series with a second capacitor and the primary winding of a transformer. The secondary winding of the transformer is connected to apply an ignition signal to the flash tube. When the flash trigger switch is switched to a conductive state, the second capacitor discharges through the flash trigger switch and the primary of the transformer. The voltage pulse induced in the secondary of the transformer is applied to the flash tube to turn the flash tube on.

The control electrode of the flash termination switch is also connected to the flash trigger switch. When the flash trigger switch is switched to a conductive state, the flash termination switch is likewise switched to a conductive state.

One problem which can occur in circuits of this type is damage to or destruction of the flash trigger switch, the flash termination switch, or both, caused by large (about 7 volts) negative gate-to-cathode voltages. Protective circuitry can be provided to overcome this problem, but such protective circuitry ordinarily involves use of several additional components, thereby increasing the cost of the electronic flash apparatus.

SUMMARY OF THE INVENTION

The present invention is a protective circuit for electronic flash apparatus which use a minimum of components to protect both the flash trigger switch and the flash termination switch against damage by large negative voltages on their control electrodes. The control electrode of the flash trigger switch is connected to the second main current carrying electrode of the flash termination switch. The control electrode of the flash termination switch is connected to the second main current carrying electrode of the flash trigger switch.

DETAILED DESCRIPTION OF THE PREFERRED EMBODIMENTS

Figure 1:
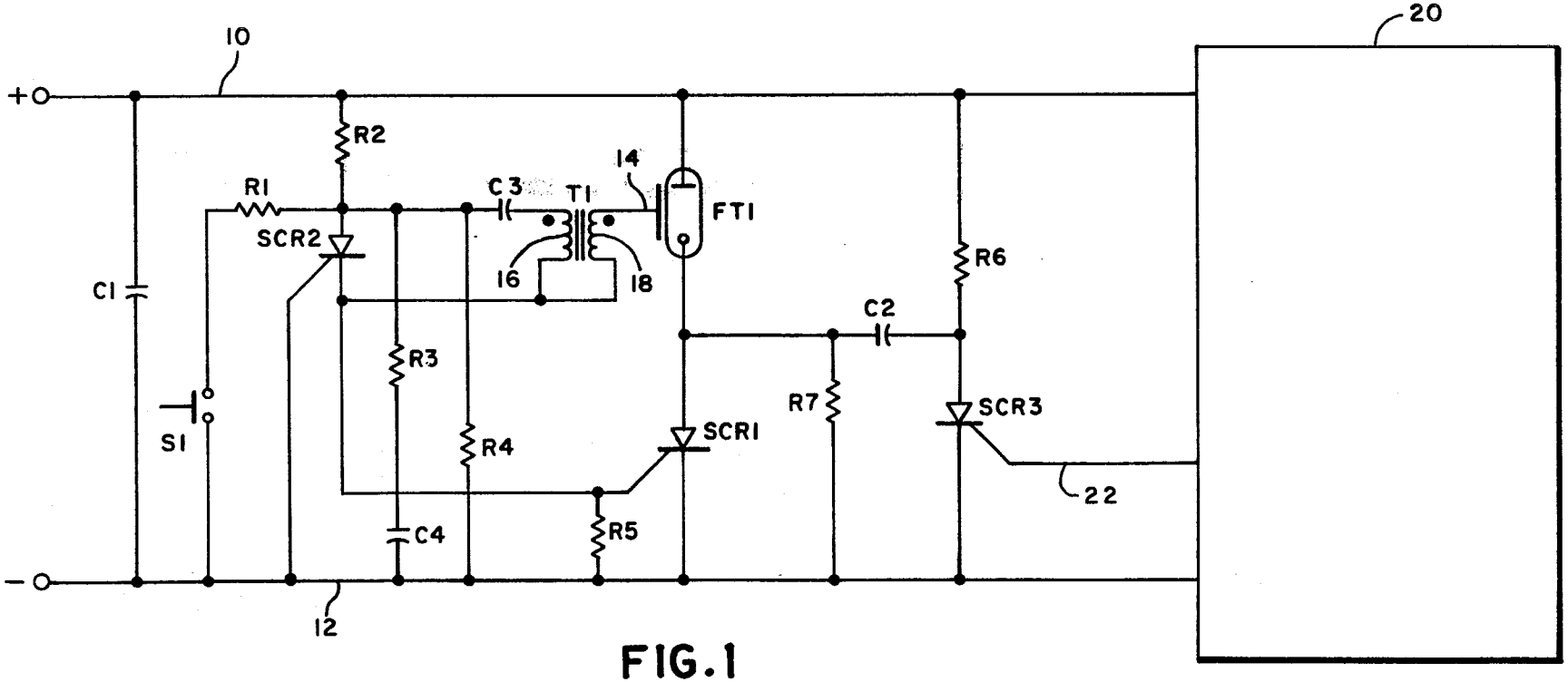
FIG. 1 is a schematic diagram of one embodiment of the electronic flash apparatus of the present invention.

FIG. 1 shows one preferred embodiment of the present invention. The electronic flash apparatus of FIG. 1 includes conductors 10 and 12. Conductor 10 is connected to a positive terminal, and conductor 12 is connected to a negative terminal.

Main flash storage capacitor C1 is connected between conductors 10 and 12. Also connected between conductors 10 and 12 is the series connection of flash tube FT1 and flash termination switch SCR1. As shown in FIG. 1, flash termination switch SCR1 may be a semiconductor switching device such as a silicon controlled rectifier. SCR1 has two main current carrying electrodes (anode asnd cathode) and a control electrode (gate) which controls the conductivity between the anode and cathode. In FIG. 1, the anode of flash tube FT1 is connected to conductor 10. The cathode of flash tube FT1 is connected to the anode of SCR1, and the cathode of SCR1 is connected to conductor 12.

In order to initiate a light flash, an ignition signal must be applied to the triggering terminal 14 of flash tube FT1. In addition, SCR1 must be turned on at the same time by a signal to the gate of SCR1. These signals are produced by the circuits which include resistors R1, R2, R3, R4, and R5, capacitors C3 and C4, contacts S1, transformer T1, and flash trigger switch SCR2.

Resistors R2 and R4 are connected in series between conductors 10 and 12 to form a voltage divider network. Connected to the junction between resistors R2 and R4 is one terminal of resistor R1. The other terminal of resistor R1 is connected to one terminal of contacts S1. The second terminal of contacts S1 is connected to conductor 12, so that R1 and S1 are connected in parallel with resistor R4.

Flash trigger switch SCR2 is, like SCR1, preferably a semiconductor switching device such as a silicon controlled rectifier. SCR2 has first and second main current carrying electrodes (anode and cathode) and a control electrode (gate). The anode of SCR2 is connected to the junction of resistors R2 and R4, and the cathode of SCR2 is connected to the gate of SCR1. The gate of SCR2 is connected to conductor 12. Resistor R5 is connected between the gate of SCR1 and conductor 12. The resistance of resistor R5 is selected to swamp out gate-cathode noise transients which could cause false triggering of SCR1 and SCR2.

Also connected in parallel with resistor R4 is a series RC network formed by resistor R3 and capacitor C4. One terminal of resistor R3 is connected to the anode of SCR2. The other terminal of resistor R3 is connected to one terminal of capacitor C4. The other terminal of capacitor C4 is connected to conductor 12.

Transformer T1 has primary and secondary windings 16 and 18, respectively. One terminal of secondary winding 18 is connected to the flash trigger electrode 14 of flash tube FT1. The other terminal is connected to one terminal of primary winding 16 and to the cathode of SCR2. The other terminal of primary winding 16 is connected to capacitor C3. The opposite terminal of capacitor C3 is connected to the anode of SCR2. Capacitor C3 and primary winding 16, therefore, are connected in parallel with the anode-to-cathode current path of SCR2.

Exposure control circuit 20, which may be one of many well known exposure control circuits used for automatic electronic flash apparatus, receives light reflected from the scene which is illuminated by the flash. When the total light received by exposure control circuit 20 exceeds a predetermined desired value, exposure control circuit 20 produces a flash termination signal at terminal 22.

FIG. 1 includes a circuit for turning off SCR1 and thus terminating the light flash in response to a flash termination signal at terminal 22. The termination circuit, which includes resistors R6 and R7, commutation capacitor C2, and commutation switch SCR3, turns off SCR1 by the well known commutation technique.

Commutation switch SCR3 is, like SCR1 and SCR2, preferably a semiconductor switching device. SCR3 has two main current carrying electrodes (anode and cathode) and a control electrode (gate). The gate of SCR3 is connected to terminal 22 to receive the flash termination signal. The cathode of SCR3 is connected to conductor 12, and the anode of SCR3 is connected to one terminal or resistor R6. The terminal of resistor R6 is connected to conductor 10. Commutation capacitor C2 is connected between the anodes of SCR1 and SCR3. Resistor R7 is connected between the anode and cathode of SCR1.

The operation of the apparatus shown in FIG. 1 is generally as follows. Capacitor C1 is charged to a relatively high voltage by the usual capacitor charging means which are not shown in FIG. 1, but which are well known in the art. Capacitor C1 is a source of energy to the electronic flash apparatus during the production of the light flash.

When capacitor C1 is charged, capacitors C2, C3, and C4 are also charged. Capacitor C2 charged through the network formed by R6, C2, and R7. The charge path for capacitor C3 is formed by R2, C3, primary winding 16, and resistor R5. The voltage on capacitor C3 is determined by the voltage divider network formed by resistors R2 and R4.

The voltage on capacitor C4 is similarly determined by voltage divider network R2–R4. The charging network for C4 includes resistors R2 and R3 and capacitor C4.

To initiate a flash, the user closes contacts S1. Current flows out of capacitor C3, through R1, S1, into the gate of SCR2 to the cathode of SCR2, through primary winding 16 and back to C3. This gate-to-cathode current triggers on SCR2. The time required to turn on SCR2 is very short, typically about 1 microsecond.

Capacitor C3, therefore, does not lose much energy in providing the turn-on current for SCR2.

Once SCR2 has turned on, capacitor C3 dumps its charge through the anode-to-cathode current path of SCR2 and into primary winding 16 of transformer T1. This produces a voltage pulse in the secondary winding 18 of T1. This voltage pulse, or "ignition signal," is applied to the triggering electrode 14 of flash tube FT1 to turn on flash tube FT1.

With SCR2 turned on, a discharge path is established for the charge stored on capacitor C4. Capacitor C4 discharges through resistor R3, SCR2 anode-to-cathode, and SCR1 gate-to-cathode, thereby turning on SCR1. The time constant of capacitor C4 and resistor R3 is selected so that the gate current to SCR1 is maintained for a period until sufficient current is available through flash tube FT1 to keep SCR1 in conduction. This prolonged turn-on current to the gate of SCR1 by series RC network R3-C4 is described in further detail in my previously mentioned co-pending application entitled "Series SCR Gate Hold-on Circuit."

Once FT1 and SCR1 have been triggered on and light is being produced by FT1, exposure control circuit 20 begins to sense the light reflected from the object being illuminated. When the total light received by exposure control circuit 20 exceeds a predetermined desired value, a flash termination signal is produced at terminal 22. This flash termination signal is applied to the gate of SCR3, thereby turning SCR3 on.

When commutation switch SCR3 is turned on, it establishes a negative voltage across the anode-cathode of SCR1. Wigh commutation switch SCR3 turned on, commutation capacitor C2 will discharge via SCR3, C1, and FT1. The established negative voltage from anode-to-cathode of SCR1 when SCR3 turns on, turns SCR1 off, thereby interrupting current flow in FT1 and turning the light flash off.

The present invention provides protection for SCR1 and SCR2 against large negative gate voltages. The gate of SCR1 is directly connected to the cathode of SCR2 and the cathode of SCR1 is directly connected to the gate of SCR2. A reverse voltage on either gate-cathode junction is a forward voltage on the other gate-cathode junction. The highest reverse voltage which can appear on either gate-cathode junction, therefore, is one gate-cathode forward voltage drop (generally on the order of 1 volt). Since SCR1 and SCR2 can accept negative gate voltages of up to about 7 volts without damage, the protection circuit of the present invention protects SCR1 and SCR2 from damage by large negative gate-to-cathode voltages.

It can be seen that the present invention provides the necessary protection for SCR1 and SCR2 with a minimum of components. In effect, SCR1 provides protection for SCR2, and SCR2 provides protection of SCR1. No additional components are required.

Figure 2:
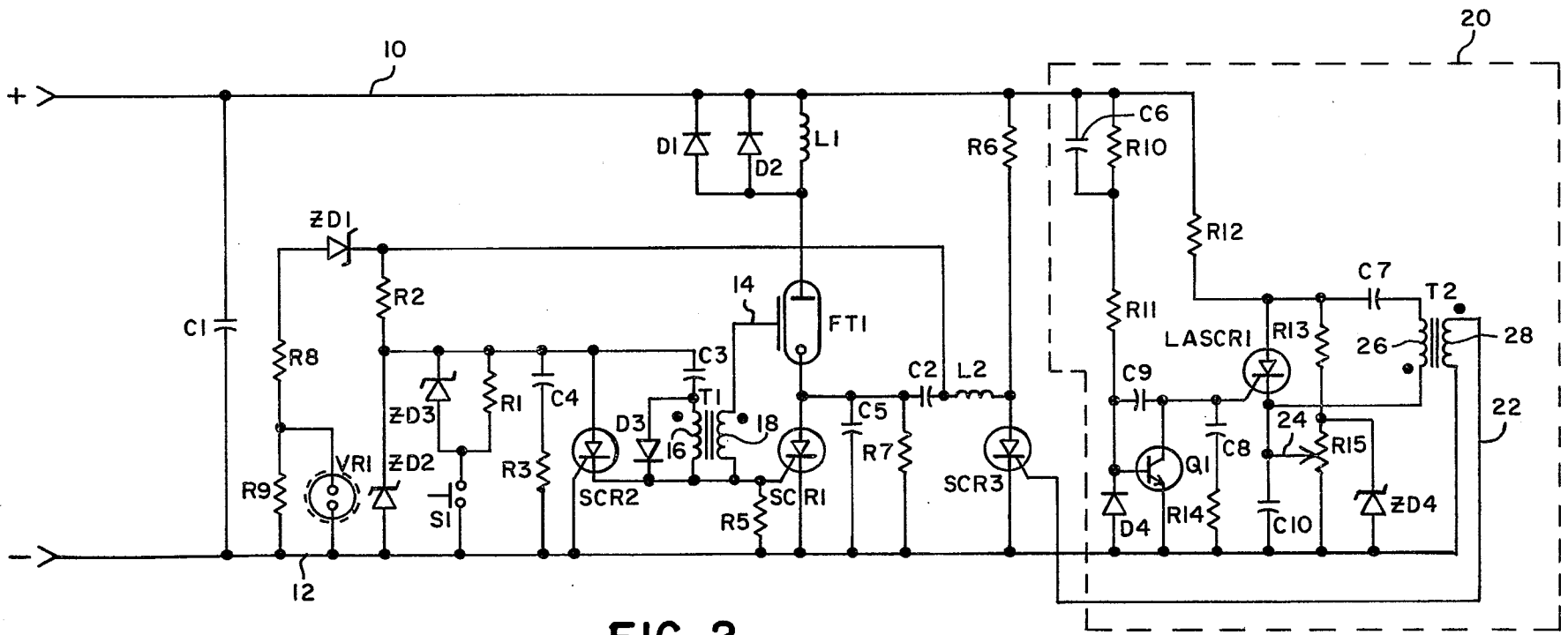
FIG. 2 is a schematic diagram of another embodiment of the electronic flash apparatus of the present invention.

FIG. 2 shows another embodiment of the present invention. The electronic flash apparatus shown in FIG. 2 is generally similar to that shown in FIG. 1, and similar letters and numerals have been used to designate similar elements. Only those elements and circuit connections which differ from FIG. 1 will be discussed in detail.

Inductor L1 is connected between conductor 10 and the anode of flash tube FT1. Diodes D1 and D2 are connected in parallel with inductor L1. The purpose of L1 is to reduce the peak current flowing into SCR1. D1 and D2 are "free wheeling" diodes which prevent a large negative voltage from being induced in L1 when SCR1 is turned off.

Inductor L2 is connected between the anode of commutation switch SCR3 and commutation capacitor C2. L2 protects SCR1 by limiting peak reverse currents of SCR1 while carriers are being swept out of SCR1 during commutation.

Capacitor C5 has been connected in parallel with resistor R7 and with the anode-to-cathode current path of termination switch SCR1. Diode D3 is connected in parallel with primary winding 16 of transformer T1.

Resistor R2 is connected to the junction of inductor L2 and commutation capacitor C2. This differs from FIG. 1, in which one terminal of resistor R2 is connected directly to conductor 10. The charging of capacitors C3 and C4, therefore, is dependent upon the charging of capacitor C2.

An indicator circuit including zener diode ZD1, resistors R8 and R9, and neon indicator lamp VR1 is connected to sense the voltage on commutation capacitor C2. One terminal of zener diode ZD1 is connected to the junction of inductor L2 and commutation capacitor C2. The other terminal of zener diode ZD1 is connected to a voltage divider circuit formed by resistors R8 and R9. One terminal of resistor R9 is connected to conductor 12.

Indicator VR1, which is connected in parallel with resistor R9, only emits light when a predetermined voltage is on commutation capacitor C2. This predetermined voltage is determined by the zener voltage of ZD1 and the values of resistors R8 and R9. The predetermined voltage has been selected so that commutation capacitor C2, as well as capacitors C3 and C4 have the necessary voltage to produce proper operation of the circuit. Indicator VR1 goes out at the initiation of commutation, and does not turn back on and emit light until both main capacitor C1 and commutation capacitor C2 are charged to the predetermined voltage.

Zener diode ZD2 is connected between resistor R2 and conductor 12. It is, therefore, connected in parallel with RC network R3-C4 and also with contacts S1 and resistor R1. Zener diode ZD2 limits the voltage on capacitors C3 and C4 to a value which is less than the the full voltage on commutation capacitor C2.

Zener diode ZD3 is connected in parallel with resistor R1. The zener voltage of ZD3 is less than the zener voltage of ZD2. ZD3 eliminates false triggering due to contact bounce, as is described in further detail in the previously mentioned copending patent application by J. R. Adams, Jr. and D. J. Wilwerding.

Exposure control circuit 20 is shown in detail in FIG. 2. The particular circuit shown in FIG. 2 is similar to the circuits described in U.S. Pat. No. 3,519,879 by F. T. Ogawa. It is understood, however, that the exposure control circuit may take many other forms.

A series circuit consisting of resistors R10, R11, and diode D4 is connected between conductors 10 and 12. Capacitor C6 is connected between conductor 10 and the junction of resistors R10 and R11. Capacitor C6, therefore, is connected in parallel with resistor R10.

The light sensing element of exposure control circuit 20 is a light activated silicon controlled rectifier, LASCR1. The anode of LASCR1 is connected to conductor 10 through resistor 12. The cathode of LASCR1 is connected to conductor 12 through capacitor C10. Integrating capacitor C8 and anticipation resistor R14 are connected between the gate of LASCR1 and conductor 12.

A series connection is formed between connectors 10 and 12 by resistors R12, R13, and R15. Resistor R13 is connected between the anode of LASCR1 and one terminal of resistor R15. The other terminal of resistor R15 is connected to conductor 12. Resistor R15 also has a sliding contact 24 which is connected to the cathode of LASCR1. The voltage on capacitor C10 and the cathode of LASCR1 is, therefore, determined by the position of sliding contact 24. Zener diode ZD4 is connected in parallel with resistor R15 to limit the voltage on resistor R15.

Transformer T2 has primary and secondary windings 26 and 28, respectively. One terminal of primary winding 26 is connected to the cathode of LASCR1, and the other terminal is connected to one terminal of capacitor C7. Th other terminal of capacitor C7 is connected to the anode of LASCR1, thereby forming a series circuit including capacitor C7, primary winding 26, and anode-cathode of LASCR1.

One terminal of secondary winding 28 is connected to conductor 12. The other terminal 22 is connected to the gate of commutation switch SCR3. Terminal 22 applies the flash termination signal to the gate of SCR3.

Gating means, shown in FIG. 2 as transistor Q1, normally disables circuit 20 and enables the circuit only upon the firing of FT1. Transistor Q1 has its collector electrode connected to the gate of LASCR1 and its emitter electrode connected to conductor 12. The collector-emitter current path of transistor Q1, therefore, is connected in parallel with integrating capacitor C8 and anticipation resistor R14. The base electrode of transistor Q1 is connected to the junction between resistor R11 and diode D4. Diode D4 is connected to be reverse biased when the base-emitter junction of transistor Q1 is forward biased. Finally, capacitor C9 is connected between the base and collector electrodes of transistor Q1.

As in FIG. 1, the protection circuit of the present invention is included in FIG. 2. The gate of SCR1 is connected to the cathode of SCR2, and the gate of SCR2 is connected to the cathode of SCR1. SCR1 and SCR2, therefore, protect one another against damage from large negative gate voltages.

The operation of the circuit shown in FIG. 2 is generally as follows. Initially, main storage capacitor C1 is charged to a relatively high voltage (generally about 360 volts) by the usual capacitor charging means (not shown). Commutation capacitor C2 has a much lower value than main capacitor C1, and thus charges to the voltage on C1 through the charging circuit formed by resistors R6 and R7 and inductor L2. With voltage on commutation capacitor C2, capacitor C2, capacitor C4 charges via resistors R6, R2, and R3 to a voltage limited by zener diode ZD2. Similarly, capacitor C3 charges via resistors R6 and R2, primary winding 16, and resistor R5 to the same voltage as capacitor C4.

Voltage indicator VR1 senses the voltage level on commutation capacitor C2 and turns on when the voltage divider formed by ZD1, R8, and R9 senses that the voltage level of C2 has exceeded a predetermined value. In one preferred embodiment, this predetermined value is about 300 volts. Indicator VR1 turns on and emits light, thereby indicating that the apparatus is ready for operation.

At this time, transistor Q1 is turned on, thereby causing the collector-emitter current path to effectively short circuit capacitor C8 and resistor R14. LASCR1, therefore, is held in an "off" or non-conductive state.

As a result, sensing circuit 20 is disabled so that commutation switch SCR3 is not prematurely actuated by extraneous causes.

To initiate a flash, contacts S1 are closed. Current flows out of capacitor C3, through zener diode ZD3, through contacts S1, from gate to cathode of SCR2 and through primary winding 16 to capacitor C3. The time required to turn on SCR2 is rather short (typically about 1 microsecond) and, therefore, C3 does not dissipate much energy until SCR2 turns on. At that time, C3 dumps its charge through SCR2 anode-to-cathode and into primary winding 16. The voltage induced in secondary winding 18 is applied to triggering electrode 14 of FT1 to turn FT1 on.

With SCR2 on, a discharge path is established for charge stored on capacitor C4. It discharges through a current path including SCR2 anode-to-cathode, SCR1 gate-to-cathode, and resistor R3. The discharge of capacitor C4 into the gate of SCR1 turns SCR1 on. The time constant of C4 and R3 is selected so that the gate current is maintained on SCR1 until sufficient current is available through flash tube FT1 to keep SCR1 in conduction.

The reduction in voltage between conductors 10 and 12 caused by the conduction of FT1 and SCR1 causes transistor Q1 to turn off. This enables exposure control circuit 20.

LASCR1 starts to receive light from the scene as a result of the operation of flash tube FT1. LASCR1 produces photocurrent which is proportional to the intensity of the incident light. This photocurrent flows through integrating capacitor C8 and resistor R14 and begins to charge capacitor C8.

As light continues to be received by LASCR1, the voltage on the gate of LASCR1 increases. When the gate trigger voltage of LASCR1 is exceeded, LASCR1 is switched into conduction. Capacitor C7 dumps its charge through the anode current path of LASCR1 and into primary winding 26 of transformer T2. This produces a voltage pulse in secondary winding 28 which is applied through terminal 22 to the gate of commutation switch SCR3.

When commutation switch SCR3 is turned on, commutation capacitor C2 is charged through L2, anode-to-cathode of SCR3, C1, L1, and FT1. This causes a reduction in voltage at the anode of SCR1 and turns off SCR1, thereby terminating the flash.

Immediately after termination of the flash, retriggering of the flash caused by false actuation of SCR1 is possible. The gas in flash tube FT1 is still ionized and, if SCR1 were once again triggered into conduction, another light flash could be produced without requiring a triggering signal at triggering terminal 14 of FT1.

The circuit shown in FIG. 2 eliminates the possibility of false triggering of SCR1 caused by contact bounce of contacts S1. Once FT1 is initially in conduction, capacitors C3 and C4 are practically discharged. In order to retrigger SCR1 as a result of contact bounce after SCR1 has turned off, capacitors C3 and C4 must charge via resistors R6 and R2 to a voltage greater than the zener voltage of zener diode ZD3. C3 and C4 cannot charge until after SCR3 is turned off (in other words, commutation is complete) because SCR3, when turned on, effectively removes the voltage source for charging C3 and C4. Once SCR3 turns off, C3 and C4 can recharge via resistor R6 and R2. Resistor R2, however, has been chosen to have a value such that the time required to charge C3 and C4 to greater than the zener voltage of ZD3 is long, typically about 0.2 seconds. This charging time is much longer than the ordinary duration of contact bounce. Contact bounce problems, therefore, are eliminated since triggering cannot occur during the time that the contacts are bouncing.

Finally, when commutation is initiated, indicator VR1 goes out. It does not turn on again until both the main capacitor C1 and the commutation capacitor C2 are charged to greater than a predetermined value. Indicator VR1, therefore, gives an accurate indication of when the circuit is again ready to operate properly.

Although the present invention has been described with reference to a series of preferred embodiments, workers skilled in the art will recognize that changes may be made in form or detail without departing from the spirit and scope of the invention. For example, although FIGS. 1 and 2 show specific electronic flash circuits, workers skilled in the art will recognize that the protection circuit of the present invention may be used with many other electronic flash circuits as well.

The embodiments of the invention in which an exclusive property or right is claimed are defined as follows:

1. In electronic flash apparatus including flash tube means for producing light; first switching means connected in series with the flash tube means, the first switching means having first and second main current carrying electrodes and a control electrode; and second switching means having first and second main current carrying electrodes and a control electrode, the second switching means for triggering the flash tube means and the first switching means; the improvement comprising:

the control electrode of the first switching means being directly connected to the second main current carrying electrode of the second switching means; and the control electrode of the second switching means being directly connected to the second main current carrying electrode of the first switching means.

2. The invention of claim 1 wherein the first and second switching means are semiconductor switching devices.

3. The invention of claim 2 wherein the first and second switching means are SCRs.

4. The invention of claim 2 wherein the first main current carrying electrodes of the first and second switching means are anodes, the second main current carrying electrodes of the first and second switching means are cathodes, and the control electrodes of the first and second switching means are gates.

5. In electronic flash tube apparatus including flash tube means for producing light, flash termination switching means having first and second main current carrying electrodes and a control electrode, the first and second main current carrying electrodes being connected in series with the flash tube means; and flash trigger switching means having first and second main current carrying electrodes and a control electrode, the flash trigger switching means for triggering the flash tube means and the flash termination switching means, a protection circuit for protecting the flash trigger switching means and the flash termination switching means against damage from reverse voltages on the control electrodes of the flash termination switching means and the flash trigger switching means, the protection circuit comprising the control electrode and the second main current carrying electrode of the flash trigger switching means being directly connected, respectively, to the second main current carrying electrode and the control electrode of the flash termination switching means.

6. The invention of claim 5 wherein the flash trigger switching means and the flash termination switching means are semiconductor switching devices.

7. The invention of claim 6 wherein the first main current carrying electrodes of the flash trigger switching means and the flash termination switching means are anodes, the second main current carrying electrodes are cathodes, and the control electrodes are gates.

* * * * *